US005360690A

United States Patent [19]

Nakano et al.

[11] Patent Number: 5,360,690

[45] Date of Patent: Nov. 1, 1994

[54] TWO-COMPONENT DEVELOPER

[75] Inventors: Tetsuya Nakano, Nabari; Mikiko Tamori, Himeji; Naruo Yabe, Kobe; Masahide Inoue, Taima; Kouichi Tsuyama, Kobe; Yoshitake Shimizu, Higashi-osaka, all of Japan

[73] Assignee: Mita Industrial Co., Ltd., Osaka, Japan

[21] Appl. No.: 90,628

[22] Filed: Jul. 12, 1993

Related U.S. Application Data

[63] Continuation of Ser. No. 755,117, Sep. 5, 1991, abandoned.

[30] Foreign Application Priority Data

Sep. 10, 1990 [JP] Japan ..... 2-237162

[51] Int. Cl.[5] ..... G03G 9/113

[52] U.S. Cl. ..... 430/110; 430/106.6; 430/108; 430/109

[58] Field of Search ..... 430/106.6, 108, 109, 430/110

[56] References Cited

U.S. PATENT DOCUMENTS 4,517,268 5/1985 Gruber et al. ..... 430/39

4,912,005 3/1990 Goodman et al. ..... 430/108

5,093,201 3/1992 Ohtani et al. ..... 428/407

*Primary Examiner*—Marion E. McCamish

*Assistant Examiner*—Rosemary Ashton

*Attorney, Agent, or Firm*—Sherman and Shalloway

[57] ABSTRACT

A two-component developer comprising a magnetic carrier having a carbon black-containing resin-coating layer and a toner composed of a carbon black-containing resin composition is disclosed. A styrene resin, an acrylic resin or a styrene-acrylic copolymer resin is selected as each of the carrier-coating resin and the toner-forming resin, and the carbon black content A in the carrier-coating layer and the carbon black content B in the toner-forming layer satisfy requirements represented by the following formulae:

$$-0.1B + 1 < A < -0.1B + 2,$$
$$5 < B < 15, \text{ and}$$
$$A > 0.$$

Namely, by adjusting the carbon black contents A and B within specific ranges relatively to each other, a two-component developer which is well-balanced between the frictional chargeability characteristic and the electric resistance is provided.

5 Claims, 1 Drawing Sheet

TWO-COMPONENT DEVELOPER

This application is a continuation of application Ser. No. 07,755,117, filed Sep. 5, 1991, now abandoned.

BACKGROUND OF THE INVENTION

1. Field of the Invention

The present invention relates to a two-component developer for use in the electrophotography. More particularly, the present invention relates to a two-component developer comprising a magnetic carrier having a carbon black-containing resin-coating layer and toner composed of a carbon black-containing resin composition.

2. Description of the Related Art

A two-component developer comprising a magnetic carrier and a toner is widely used as the developer in a commercial electrophotographic process. A product obtained by granulating a composition comprising a coloring agent and other toner additives dispersed in a binder resin to a predetermined particle size by pulverization-classification, spray granulation, suspension polymerization, dispersion polymerization or the like is generally used as the toner. For a toner to be used for an office copying machine, in order to control the coloration and the electric resistance, carbon black is generally incorporated in an amount of 5 to 15% by weight into the resin.

Iron powder, ferrite and the like are used as the magnetic carrier, and in order to control consumption of the carrier, the antistatic property and the electric resistance, the magnetic carrier is coated with a resin, and it is known that carbon black is incorporated into this coating of the carrier. For example, Japanese Unexamined Patent Publication No. 61-260254 discloses a carrier for developing an electrostatic latent image, comprising a carrier core having the surface coated with a silicone resin containing carbon black comprising a mixture of furnace black and acetylene black. Furthermore, Japanese Unexamined Patent Publication No. 62-182759 discloses a carrier for developing an electrostatic latent image, which comprises a carrier core having the surface coated with a silicone resin containing carbon black surface-treated with an aminosilane coupling agent or the like.

Resins used for coating carriers have merits and demerits. For example, the above-mentioned silicone resin is excellent in the durability but is defective in that the electric resistance is high, rise of charging is slow and the chargeability is relatively unstable. A fluorine resin is excellent in the consumption resistance, but in view of the frictional charging system, the fluorine resin can hardly be used for a magnetic carrier for a negatively chargeable toner. A styrene resin and an acrylic resin are most excellent in the charging properties, but they are poor in the durability and insufficient in the consumption resistance.

It is deemed that the significance of the above-mentioned proposals resides in that the electric resistance of the coating resin layer of the carrier is adjusted by incorporating carbon black in the coating resin layer. However, in a two-component developer, charging of the toner is greatly influenced by frictional charging properties and electric characteristics of not only the coating layer of the magnetic carrier but also the resin composition constituting the toner. Accordingly, with respect to both of the magnetic carrier-coating layer and the toner, an optimum combination of the frictional charging properties and the electric characteristics should be selected.

SUMMARY OF THE INVENTION

The present inventors found that a styrene resin, an acrylic resin and a styrene-acrylic copolymer resin are selected as the carrier-coating resin and the toner-forming resin and amounts of carbon black incorporated into these resins are adjusted with specific ranges, a chargeability optimum for the toner can be obtained.

It is a primary object of the present invention to provide a two-component developer for the electrophotography, in which charging of a toner is controlled so that an image having a high density and a high contrast can be obtained without such defects as premature printing formation of brush marks, scattering of the toner and carrier dragging.

Another object of the present invention is to provide a two-component developer, in which an optimum combination of frictional charging properties and electric characteristics of a magnetic carrier and a toner can be obtained and such combined properties and characteristics are excellent in the stability and durability.

In accordance with the present invention, there is provided a two-component developer comprising a magnetic carrier having a carbon black-containing resin coating layer and a toner composed of a carbon black-containing resin composition, wherein each of the carrier-coating resin and the toner-forming resin is a resin selected from the group consisting of a styrene resin, an acrylic resin and a styrene-acrylic copolymer resin, and the carbon black content A (% by weight) in the carrier-coating layer and the carbon black content B (% by weight) in the toner satisfy requirements represented by the following formulae:

$$A < -0.1B + 2 \quad (1),$$

$$A > -0.1B + 1 \quad (2),$$

$$5 < B < 15 \quad (3), \text{ and}$$

$$A > 0 \quad (4).$$

In the present invention, it is preferred that the carbon black in the toner be carbon black having a dibutyl phthalate (DBP) adsorption of 90 to 130 ml100 g

DETAILED DESCRIPTION OF THE INVENTION

Figure 1:
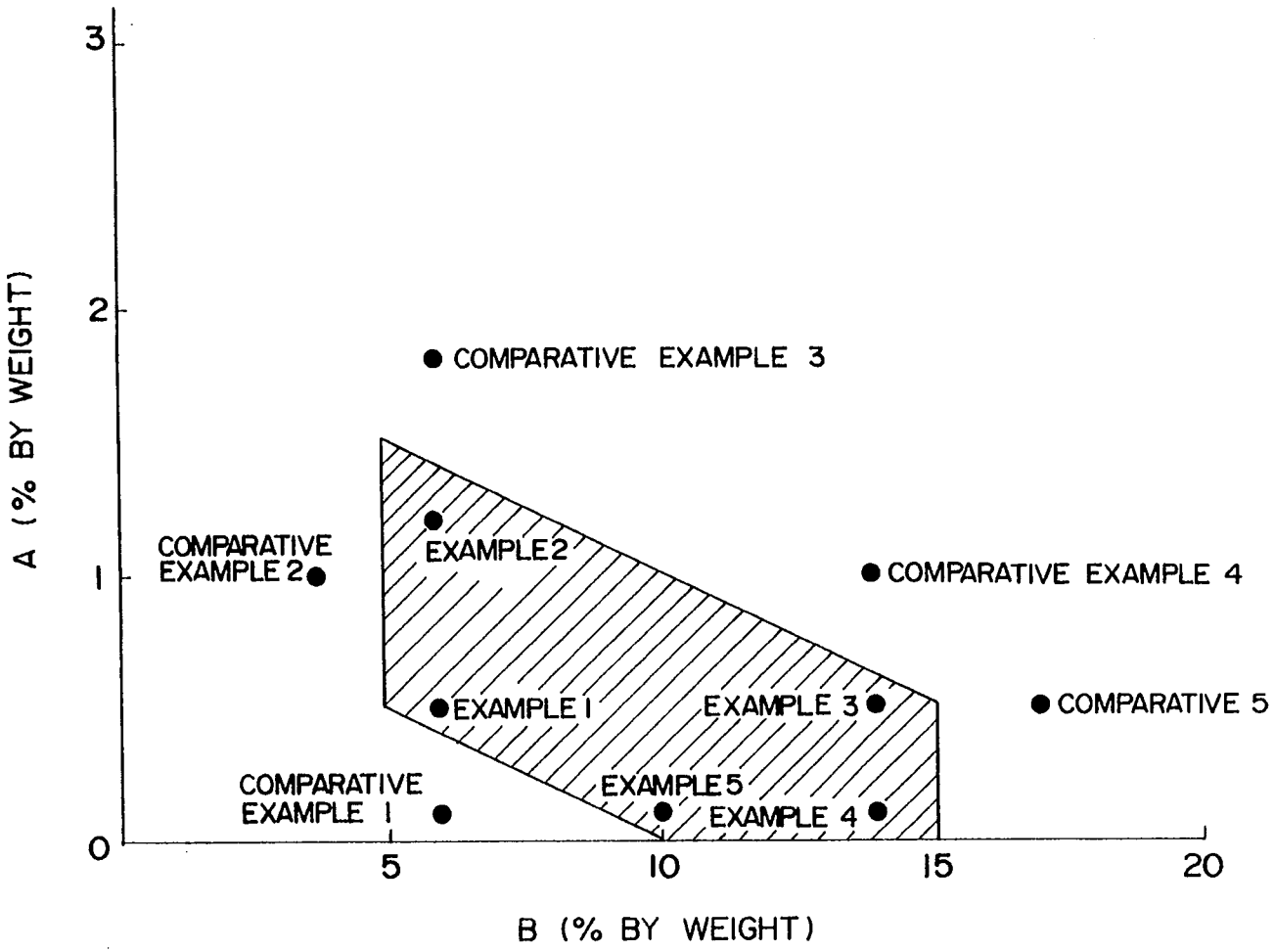
FIG. 1 is a graph illustrating the relation between the carbon black content A in the carrier-coating layer and the carbon black content B in the toner.

In the present invention, at least one resin selected from the group consisting of a styrene resin, an acrylic resin and a styrene-acrylic copolymer resin is chosen among various resins and used as the carrier-coating resin and the toner-forming resin. The reason why these resins are used in the present invention is that these resins give a best chargeability to the toner and they are excellent in the carbon black dispersibility.

In the present invention, since a styrene resin, an acrylic resin or a styrene-acrylic copolymer resin is used as both of the carrier-coating resin and the toner-forming resin, it becomes important that the carbon black content A in the carrier-coating layer and the carbon black content B in the toner should be determined so that requirements represented by the above-mentioned empirical formulae are satisfied.

The range of the carbon black content A in the carrier-coating layer and the carbon black content B in the toner, used in the present invention, is a hatched region in FIG. 1 of the accompanying drawing. In general, the carbon black content in the carrier-coating layer and the carbon black content in the toner have close relations to the electric resistance of the carrier-coating layer and the electric resistance of the toner, and as the content becomes large, the electric resistance is reduced and as the content is reduced, the electric resistance increases. The two-component developer as a whole has a range of the electric resistance optimum for the density and quality of the formed image. If this electric resistance is relatively low, the density is increased, but premature printing, formation of brush marks and scattering of the toner are caused and the image quality is degraded. If the electric resistance of the developer is relatively high, scattering of the toner is not caused to occur but the density becomes insufficient and carrier dragging is readily caused. Accordingly, it is generally preferred that a high-resistance toner be combined with a low-resistance carrier, or a low-resistance toner be combined with a high-resistance carrier. With reference to the relation between the resistances of the toner and carrier and the carbon black concentrations in the toner and carrier-coating layer, it is construed that the influence of the carbon black concentration in the toner on the electric resistance of the developer as a whole is relatively small and the influence of the carbon black concentration in the carrier-coating layer on the electric resistance of the developer as a whole is relatively large. It is considered that this is the reason why in the diagram of FIG. 1, the allowance range of the carbon black content B in the toner is relatively broad but the allowable range of the carbon black content A in the carrier-coating layer is relatively narrow.

In fact, in a region ($B<5$) on the left side over the hatched region in FIG. 1, the electric resistance of the developer as a whole is too high, however adjusted is the electric resistance of the magnetic carrier-coating layer, and it is impossible to adjust the electric resistance of the developer to a preferred range of $10^8$ to $10^{13}$ $\Omega$-cm. Furthermore, in a region ($B>15$) on the right side over the hatched region of FIG. 1, the electric resistance of the developer as a whole is too low, however adjusted is the electric resistance of the magnetic carrier-coating layer, and it is impossible to adjust the electric resistance of the developer as a whole within the above-mentioned preferred range. In region ($A>-0.1B+2$) on the upper side over the hatched region of FIG. 1, the electric resistance of the carrier-coating layer to be combined with the toner is too low, and hence, troubles such as premature printing, formation of brush marks and scattering of the toner are caused, though the image density is increased. Moreover, in a region ($A<-0.1B+1$) on the lower side over the hatched region of FIG. 1, the electric resistance of the carrier-coating layer to be combined with the toner is too high, and the image density becomes insufficient and carrier dragging is readily caused. According to the present invention, by selecting specific resins as the carrier-coating resin and the toner-forming resin and adjusting the contents of carbon black to be incorporated into these resins within the hatched region of FIG. 1, a toner image having a high density and a high contrast can be formed without premature printing, formation of brush marks and carrier dragging. In this two-component developer, an optimum combination of the frictional charging properties and electric properties of the carrier and toner can be maintained and therefore, the above-mentioned function can be stably manifested over a long period of time.

In the present invention, it is especially preferred that at least carbon black to be incorporated into the toner be carbon black having a dibutyl phthalate (DBP) adsorption of 90 to 130 ml/100 g. Various carbon blacks differing in the DBP adsorption in a broad range are known. Carbon black having a DBP adsorption smaller than 90 ml/100 g is generally called low-structure carbon black and has a reduced tendency to form a chain structure. Accordingly, in case of this carbon black, it is apprehended that the electric resistance of the toner will increase, and this carbon black is not suitable for attaining the objects of the present invention. On the other hand, carbon black having a DBP adsorption larger than 130 ml/100 g is called high-structure carbon black and since the carbon black has an especially high tendency to form a high structure, there is a risk of reduction of the resistance and the carbon black is not suitable for attaining the objects of the present invention.

Magnetic Carrier

In the present invention, the kind of the magnetic carrier is not particularly critical, so far as it has a coating layer of a carbon black-containing resin. As the resin, there can be mentioned a styrene resin, an acrylic resin, a styrene-acrylic copolymer resin, and mixtures of two or more of these resins.

As the monomer constituting the styrene resin, there can be mentioned monomers represented by the following formula:

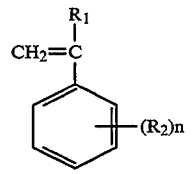

(5)

wherein $R_1$ represents a hydrogen atoms, a lower alkyl group (having up to 4 carbon atoms) or a halogen atom, $R_2$ represents a substituent such as a lower alkyl group or a halogen atom, and n is an integer of up to 2, including zero, such as styrene, vinyltoluene, $\alpha$-methylstyrene, $\alpha$-chlorostyrene and vinylxylene, and vinylnaphthalene. Of these monomers, styrene is preferably used.

As the acrylic monomer, there can be mentioned monomers represented by the following formula:

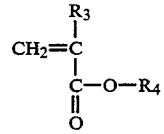

(6)

wherein $R_3$ represents a hydrogen atom or a lower alkyl group, and $R_4$ represents a hydrogen atom or an alkyl, hydroxyalkyl, alkoxyalkyl or aminoalkyl group having up to 18 carbon atoms, such as ethyl acrylate, methyl methacrylate, butyl acrylate, butyl methacrylate, 2-ethylhexyl acrylate, 2-ethylhexyl methacrylate, hydroxyethyl (meth)acrylate, hydroxypropyl (meth)acrylate, aminoethyl (meth)acrylate, acrylic acid and methacrylic acid. As the acrylic monomer, there can be used other ethylenically unsaturated carboxylic acids and anhydrides thereof, such as maleic anhydride, crotonic acid and iraconic acid.

A styrene-acrylic copolymer resin is especially suitable for attaining the objects of the present invention, and this copolymer resin is a copolymer comprising at least one kind of styrene units of the formula (5) and at least one kind of acrylic units represented by the formula (6). The styrene-acrylic copolymer resin which is excellent in charging characteristics, carbon black dispersibility and adhesion to the magnetic carrier and is especially suitable for the carrier coating is a copolymer resin comprising (i) 10 to 30% by weight of styrene, (ii) 70 to 80% by weight of a lower alkyl (having up to 3 carbon atoms) (meth)acrylate, (iii) 0.1 to 2% by weight of a higher alkyl (having at least 4 carbon atoms) (meth)acrylate and (iv) 0.1 to 2% by weight of a hydroxylalkyl (meth)acrylate. In order to increase the adhesion to the magnetic carrier, increase the durability of the coating layer and further improve the charging properties, an amino resin such as a melamine resin or a urea resin can be used in combination with the styrene-acrylic copolymer resin in an amount of up to 50% by weight based on the styrene-acrylic copolymer resin.

Of course, carbon black having a DBP adsorption, described hereinbefore, of 90 to 130ml/100 g can be used as the carbon black to be combined with the coating layer-forming resin. Furthermore, low-structure carbon black or high-structure carbon black can be used. The carbon black content in the coating layer-forming resin is within the above-mentioned range, but the lower limit of the carbon black content is preferably 0.01% by weight, especially 0.1% by weight. As the carbon black, there can be used not only unprocessed carbon black but also carbon black to which at least one member selected from the group consisting of styrene type monomers and acrylic monomers is graft-copolymerized. If grafted carbon black is used, prominent advantages can be attained with respect to the dispersibility in the coating layer-forming resin, the dispersion stability and the electric characteristics. Alternatively, carbon black surface-treated with a silane coupling agent, a titanium coupling agent or other surface-treating agent can be used.

Known means can be optionally adopted for forming a coating layer on the magnetic carrier. For example, the above-mentioned resin is dissolved in an aromatic solvent such as toluene, or other solvent such as a ketone type solvent, an ether type solvent or an ester type solvent, and a predetermined amount of carbon black is dispersed in the formed solution to form a starting liquid for forming a coating layer. This starting liquid is applied to a magnetic carrier by spray coating, dip coating or the like, and if necessary, the coated magnetic carrier is dried, whereby a carbon black-containing resin-coated magnetic carrier is obtained. There is preferably adopted a method in which a fluidized bed of the magnetic carrier is formed and the above-mentioned starting liquid is sprayed in this fluidized bed, because formation of a uniform coating and uniform drying can be simultaneously accomplished. The thickness of the carbon black-containing resin-coating layer may be considerably small, and the amount coated of the carbon black-containing resin is generally 0.01 to 5% by weight, especially 0.1 to 2% by weight, based on the magnetic carrier.

As the magnetic carrier, either a ferrite carrier or an iron powder carrier can be used, but the ferrite carrier is preferably used in general.

Spherical ferrite particles are preferably used as the ferrite particles, and it is preferred that the particle size of the ferrite particles be 20 to 140 $\mu$m, especially 50 to 100 $\mu$m.

As the ferrite, there have been used sintered ferrite particles composed of at least one member selected from the group consisting of zinc iron oxide ($ZnFe_2O_4$), yttrium iron oxide ($Y_3Fe_5O_{12}$), cadmium iron oxide ($CdFe_2O_4$), gadolinium iron oxide ($Gd_3Fe_5O_{12}$), copper iron oxide ($CuFe_2O_4$), lead iron oxide ($PbFe_{12}O_{19}$), nickel iron oxide ($NiFe_2O_4$), neodium iron oxide ($NdFeO_3$), barium iron oxide ($BaFe_{12}O_{19}$), magnesium iron oxide ($MgFe_2O_4$), manganese iron oxide ($MnFe_2O_4$) and lanthanum iron oxide ($LaFeO_3$). Especially, soft ferrites containing at least one member, preferably at least two members, selected from the group consisting of Cu, Zn, Mg, Mn and Ni, for example, a copper/zinc/magnesium ferrite, can be used.

Toner

A toner prepared by incorporating carbon black into the above-mentioned styrene resin, acrylic resin or styrene-acrylic copolymer resin and pulverizing the composition to a predetermined particle size is used as the toner in the present invention.

As the styrene resin, acrylic resin or styrene-acrylic copolymer resin, those comprising monomers represented by formula (5) and/or formula (6) mentioned above with respect to the magnetic carrier are used. Among these resins, a styrene-acrylic copolymer resin is suitable for attaining the objects of the present invention, and from the viewpoint of the chargeability and fixing property, a styrene-acrylic copolymer comprising (i) 75 to 95% by weight of styrene, (ii) 5 to 25% by weight of a lower alkyl (having up to 3 carbon atoms) (meth)acrylate and (iii) 0.5 to 5% by weight of a higher alkyl (having at least 4 carbon atoms) (meth)acrylate is especially preferably used.

In order to prevent blocking in a developing device and maintain a good fixing property, it is preferred that the resin used should have a glass transition point (Tg) of 50° to 75° C. Furthermore, in order to prevent cold offset and hot offset and obtain an excellent fixing performance, it is preferred that the weight average molecular weight ($\overline{M}w$) be within the range of from $10\times10^4$ to $20\times10^4$ and that the molecular weight dispersion ($\overline{M}w/\overline{M}n$) be within the range of from10 to 30.

The carbon black used for a toner in the present invention is as mentioned above with respect to the carrier, and as in the case of the magnetic carrier, when grafted carbon black or surface-treated carbon black is used for the toner, excellent advantages can be attained.

Known toner additives, for example, a charge controlling agent and a release agent, can be incorporated in the toner.

Known charge-controlling agents can be used. For example, there can be mentioned oil-soluble dyes such as Nogrosine Base (CI 50415), Oil Black (CI 20150) and Spilon Black, 1:1 or 2:1 type metal complex dyes, and metal salts of naphthoic acid, fatty acid soaps and resin acid soaps.

As the release agent, there can be used various waxes such as a polypropylene wax, a polyethylene wax, an oxidized polyethylene wax, a mineral wax, a vegetable wax and an animal wax.

It is preferred that the charge-controlling agent be incorporated in an amount of 1 to 4% by weight and that the release agent be incorporated in an amount of 1 to 5% by weight.

The particle size of toner particles is preferably such that the volume-based median diameter measured by a Coulter counter is 8 to 14 μm, especially 10 to 12 μm. The particulate shape may be an indeterminate shape formed by melt kneading and pulverization, or a spherical shape formed by dispersion or suspension polymerization.

In order to improve the flowability of the toner particles, finely divided silica (aerosil) and the like can be sprinkle-coated on surfaces of the toner particles.

Developer

In the present invention, the carbon black-containing resin-coated magnetic carrier and the toner are mixed at a known mixing ratio, and the formed two-component developer can be used as the developer. The carrier and the toner are used at a mixing ratio of from 99/1 to 85/15, especially from 98/2 to 95/5. At the development of a charged image, the so-formed developer is supplied onto a developing sleeve having magnets arranged therein to form a magnetic brush of the developer on the sleeve. This magnetic brush is brought into sliding contact with a supporting surface of a photosensitive material or the like having a charged image to form a toner image.

According to the present invention, by selecting a styrene resin, acrylic resin or styrene-acrylic copolymer resin having an excellent chargeability for each of the carrier-coating resin and the toner-forming resin and adjusting the amount of carbon black incorporated in the carrier-coating layer and the amount of carbon black incorporated in the toner-forming resin within specific ranges relatively to each other, a two-component developer in which the frictional chargeability and the electric resistance are well-balanced with each other can be provided, and by using this two-component developer, an image having a high density and a high contrast can be formed without such defects as premature printing, brush marks, scattering of the toner and carrier dragging.

EXAMPLES

The present invention will now be described in detail with reference to the following examples that by no means limit the scope of the invention.

EXAMPLE 1

Preparation of Carrier

A resin comprising 99.5 parts by weight of a methyl methacrylate polymer having Tg of 100° C. was dissolved in toluene and 0.5 part by weight of carbon black was dispersed in the solution to obtain a coating layer-forming starting liquid. A fluidized bed of Cu-Zn type ferrite particles as the core material was formed, and the starting liquid was sprayed in the fluidized bed to bed to form a carbon black-containing resin coating layer on the surface of the core material.

Preparation of Toner

A toner was prepared by melt-kneading 88 parts by weight of a styrene (St)/butyl acrylate (BA)/methyl methacrylate (MMA) copolymer having an St/BA/MMA weight ratio of 85/14/1, Tg of 59° C., $\overline{M}w$ of 147,000 and $\overline{M}w/\overline{M}n$ of 15.1, 6 parts by weight of carbon black having DBP adsorption of 114 ml/100 g, 2.5 parts by weight of a metal-containing azo dye and 3 parts by weight of low-molecular-weight polypropylene, cooling the melt, pulverizing and classifying the solid, and adding 0.5 part by weight of hydrophobic silica to effect the surface treatment.

The so-obtained carrier and toner were mixed at a weight ratio of 95/5 to obtain a developer.

This developer was charged in an electrophotographic copying machine (Model DC5585 supplied by Mita Industrial Co., Ltd.), and the copying test was carried out to obtain 100,000 copies. Evaluations were made on the image density (ID), fog density (FD), premature printing, formation of brush marks, carrier dragging and scattering of the toner.

The image density (ID) and fog density (FD) were determined by a reflection densitometer (Model TC-6D supplied by Tokyo Denshoku).

The results of the evaluation tests are shown in Table 1.

EXAMPLE 2

Preparation of Carrier

A carrier was prepared in the same manner as described in Example 1 by using Cu-Zn-Mg type ferrite particles as the core material, and 98.9 parts by weight of a styrene (St)/ethyl acrylate (EA)/dodecyl methacrylate/hydroxymethacrylate copolymer having Tg of 64° C. and an St/EA/dodecyl methacrylate/hydroxymethacrylate weight ratio of 18/78/2/2 and 1.2 parts by weight of carbon black for the coating layer.

Preparation of Toner

A toner was prepared in the same manner as described in Example 1 by using 88 parts by weight of a styrene/butadiene copolymer having an St/butadiene weight ratio of 68/32, Tg of 69° C., $\overline{M}w$ of 173,000 and $\overline{M}w/\overline{M}n$ of 10.2, 6 parts by weight of carbon black having a DBP adsorption of 96 ml/100 g, 2.5 parts by weight of a metal containing azo dye, 3 parts by weight of low-molecular-weight polypropylene and 0.5 part by weight of hydrophobic silica.

Then, in the same manner as described in Example 1, a developer was prepared and various evaluation tests were carried out.

The obtained results are shown in Table 1.

EXAMPLE 3

Preparation of Carrier

A carrier was prepared in the same manner as described in Example 1 by using Cu-Zn-Mn type ferrite particles as the core material, and 99.5 parts by weight of a styrene polymer having Tg of 82° C. and 0.5 part by weight of carbon black for the coating layer.

Preparation of Toner

A toner was prepared in the same manner as described in Example 1 by using 80 parts by weight a methyl methacrylate (MMA)/butyl methacrylate (BMA) copolymer having an MMA/BMA weight ratio of 58/42, Tg of 63° C., $\overline{M}w$ of 136,000 and $\overline{M}w/\overline{M}n$ of 12.8, 14 parts by weight of carbon black having a DBP adsorption of 107 ml/100 g, 2.5 parts by weight of a metal-containing azo dye, 3 parts by weight of low-molecular-weight polypropylene and 0.5 part by weight of hydrophobic silica.

In the same manner as described in Example 1, a developer was prepared and various evaluation tests were carried out.

The obtained results are shown in Table 1.

EXAMPLE 4

Preparation of Carrier

A carrier was prepared in the same manner as described in Example 1 by using Cu-Zn-Ni type ferrite particles as the core material, and 99.9 parts by weight of a styrene (St)/ethyl methacrylate (EMA) copolymer having an St/EMA weight ratio of 22/78 and Tg of 79° C. and 0.1 part by weight of carbon black for the coating layer.

Preparation of Toner

A toner was prepared in the same manner as described in Example 1 by using 80 parts by weight of a styrene (St)/butyl methacrylate (BMA)/2-ethylhexyl acrylate copolymer having an St/BMA/2-ethylhexyl acrylate weight ratio of 75/15/10, Tg of 57° C., $\overline{M}w$ of 198,000 and $\overline{M}w/\overline{M}n$ of 25.8, 14 parts by weight of carbon black having a DBP adsorption of 121 ml/100 g, 2.5 parts by weight of a metal-containing azo dye, 3 parts by weight of low-molecular-weight polypropylene and 0.5 part by weight of hydrophobic silica.

In the same manner as described in Example 1, a developer was prepared and various evaluation tests were carried out.

The obtained results are shown in Table 1.

EXAMPLE 5

Preparation of Carrier

A carrier was prepared in the same manner as described in Example 1 by using Cu-Zn-Mg-Ni ferrite particles as the core material, and 99.9 parts by weight of an ethyl methacrylate polymer having Tg of 65° C. and 0.1 part by weight of carbon black for the coating layer.

Preparation of Toner

A toner was prepared in the same manner as described in Example 1 by using 84 parts by weight of a styrene (St)/stearyl methacrylate having an St/stearyl methacrylate weight ratio of 67/33, Tg of 59° C., $\overline{M}w$ of 64,000 and $\overline{M}w/\overline{M}n$ of 21.6, 10 parts by weight of carbon black having a DBP adsorption of 109 ml/100 g, 2.5 parts by weight of a metal-containing azo dye, 3 parts by weight of low-molecular-weight polypropylene and 0.5 part by weight of hydrophobic silica.

In the same manner as described in Example 1, a developer was prepared and various evaluation tests were carried out.

The obtained results are shown in Table 1.

Comparative Example 1

Preparation of Carrier

A carrier was prepared in the same manner as described in Example 1 by using Cu-Zn-Mg ferrite particles as the core material, and 99.9 parts by weight of a styrene polymer having Tg of 82° C. and 0.1 part by weight of carbon black for the coating layer.

Preparation of Toner

A toner was prepared in the same manner as described in Example 1 by using 88 parts by weight of a methyl methacrylate (MMA)/ethyl acrylate (EA) copolymer having an MMA/EA weight ratio of 74/26, Tg of 69° C., $\overline{M}w$ of 138,000 and $\overline{M}w/\overline{M}n$ of 17.3, 6 parts weight of carbon black having a DBP adsorption of 110 ml/100 g, 2.5 parts by weight of a metal-containing azo dye, 3 parts by weight of low-molecular-weight polypropylene and 0.5 part by weight of hydrophobic silica.

In the same manner as described in Example 1, a developer was prepared and various evaluation tests were carried out.

The obtained results are shown in Table 1.

Comparative Example 2

Preparation of Carrier

A carrier was prepared in the same manner as described in Example 1 by using Cu-Zn-Mn-Ni type ferrite particles as the core material, and 99.0 parts by weight of a styrene (St)/butyl methacrylate (BMA)-/ethyl acrylate (EA)copolymer having an St/BMA/EA weight ratio of 45/35/20 and Tg of 71° C. and 1.0 part of carbon black for the coating layer.

Preparation of Toner

A toner was prepared in the same manner as described in Example 1 by using 90 parts by weight of a styrene (St)/ethyl acrylate (EA)/2-hydroxyethyl acrylate copolymer having an St/EA/2-hydroxyethyl acrylate weight ratio of 77/19/4, Tg of 57° C., $\overline{M}w$ of 149,000 and $\overline{M}w/\overline{M}n$ of 10.6, 4 parts by weight of carbon black having a DBP adsorption of 104 ml/100 g, 2.5 parts by weight of a metal-containing azo dye, 3 parts by weight of low-molecular-weight polypropylene and 0.5 part by weight of hydrophobic silica.

In the same manner as described in Example 1, a developer was prepared and various evaluation tests were carried out.

The obtained results are shown in Table 1.

Comparative Example 3

Preparation of Carrier

A carrier was prepared in the same manner as described in Example 1 by using Cu-Zn type ferrite particles as the core material, and 98.0 parts by weight of a methyl methacrylate (MMA)/ethyl acrylate (EA)/butyl acrylate (BA) copolymer having an MMA/EA/BA weight ratio of 63/22/15 and Tg of 74° C. and 2.0 parts by weight of carbon black for the coating layer.

Preparation of Toner

A toner was prepared in the same manner as described in Example 1 by using 88 parts by weight of a styrene (St)/acrylonitrile (AN)/methyl acrylate (MA) copolymer having an St/An/MA weight ratio of 67/20/13, Tg of 66° C., $\overline{M}w$ of 168,000 and $\overline{M}w/\overline{M}n$ of 11.0, 6 parts by weight of carbon black having a DBP adsorption of 93 ml/100 g, 2.5 parts by weight of a metal-containing azo dye, 3 parts by weight of low-molecular-weight polypropylene and 0.5 part by weight of hydrophobic silica.

In the same manner as described in Example 1, a developer was prepared and various evaluation tests were carried out.

The obtained results are shown in Table 1.

Comparative Example 4

Preparation of Carrier

A carrier was prepared in the same manner as described in Example 1 by using Cu-Zn-Mg-Mn type ferrite particles as the core material, and 99.0 parts by weight of a styrene (St)/butyl acrylate (BA) copolymer having an St/BA weight ratio of 67/33 and Tg of 77° C. and 1.0 part by weight of carbon black for the coating layer.

Preparation of Toner

A toner was prepared in the same manner as described in Example 1 by using 80 parts by weight of a styrene (St)/2-hydroxypropyl acrylate copolymer having an St/2-hydroxypropyl acrylate weight ratio of 87/13, Tg of 68° C., $\overline{M}w$ of 171,000 and $\overline{M}w/\overline{M}n$ of 26.1, 14 parts by weight of carbon black having a DBP adsorption of 108 ml/100 g, 2.5 parts by weight of a metal-containing azo dye, 3 parts by weight of low-molecular-weight polypropylene and 0.5 part by weight of hydrophobic silica.

In the same manner as described in Example 1, a developer was prepared and various evaluation tests were carried out.

The obtained results are shown in Table 1.

Comparative Example 5

Preparation of Carrier

A carrier was prepared in the same manner as described in Example 1 by using Cu-Zn type ferrite particles as the core material, and 99.5 parts by weight of a styrene (St)/acrylonitrile (AN) copolymer having an St/AN weight ratio of 88/12 and Tg of 92° C. and 0.5 part by weight of carbon black for the coating layer.

Preparation of Toner

A toner was prepared in the same manner as described in Example 1 by using 78 parts by weight of a methyl methacrylate (MMA)/ethyl methacrylate (EMA)/butyl acrylate (BA) copolymer having an MMA/EMA/BA weight ratio of 57/19/14, Tg of 69° C., $\overline{M}w$ of 131,000 and $\overline{M}w/\overline{M}n$ of 22.6, 16 parts by weight of carbon black having a DBP adsorption of 111 ml/100 g, 2.5 parts by weight of a metal-containing azo dye, 3 parts by weight of low-molecular-weight polypropylene and 0.5 part by weight of hydrophobic silica.

In the same manner as described in Example 1, a developer was prepared and various evaluation tests were carried out.

The obtained results are shown in Table 1.

The relation between the black carbon content A (% by weight) in the carrier-coating layer and the carbon black content B (% by weight) in the toner, observed with respect to each of the developers obtained in Examples 1 through 5 and Comparative Examples 1 through 5, is shown in FIG. 1.

TABLE 1

| | A (% by weight) | B (% by weight) | ID | FD | Premature Printing | Brush Mark | Carrier Dragging | Scattering of Toner |
|---|---|---|---|---|---|---|---|---|
| Example 1 | 0.5 | 6 | 1.320 | 0.003 | ○ | ○ | ○ | ○ |
| Example 2 | 1.2 | 6 | 1.333 | 0.004 | ○ | ○ | ○ | ○ |
| Example 3 | 0.5 | 14 | 1.347 | 0.002 | ○ | ○ | ○ | ○ |
| Example 4 | 0.1 | 14 | 1.331 | 0.003 | ○ | ○ | ○ | ○ |
| Example 5 | 0.1 | 10 | 1.319 | 0.003 | ○ | ○ | ○ | ○ |
| Comparative Example 1 | 0.1 | 6 | 0.999 | 0.013 | ○ | ○ | X | ○ |
| Comparative Example 2 | 1.0 | 4 | 1.043 | 0.013 | ○ | ○ | Δ | ○ |
| Comparative Example 3 | 2.0 | 6 | 1.110 | 0.015 | Δ | Δ | ○ | ○ |
| Comparative Example 4 | 1.0 | 14 | 1.416 | 0.008 | X | X | ○ | X |
| Comparative Example 5 | 0.5 | 16 | 1.399 | 0.007 | X | Δ | ○ | X |

Note
(Premature printing, brush mark, carrier dragging)
○: no practical disadvantage
Δ: relatively conspicuous
X: considerably conspicuous
(Scattering of Toner)
○: no practical disadvantage
X: falling of toner on image As is apparent from Table 1, in Examples 1 through 5 where the carbon black content A in the carrier-coating layer and the carbon black content B in the toner satisfy the requirements represented by the experimental formulae (1) through (4) (in the hatched region in FIG. 1), the image density is high and fogging is controlled, and therefore, an image having a high contrast can be obtained. Furthermore, a good image can be obtained without premature printing, formation of brush marks or carrier dragging.

On the other hand, in Comparative Example 1 which is included in a region on the lower side over the hatched region in FIG. 1 ($A<-0.1B+1$), the image density is very low and an image having a poor contrast is obtained with conspicuous fogging. Furthermore, carrier dragging is conspicuous.

In Comparative Example 2 which is included in a region on the left side over the hatched region in FIG. 1 ($B<5$), the image density is low and carrier dragging is caused with conspicuous fogging.

In Comparative Examples 3, 4 and 5 which are included in a region on the upper side over the hatched region in FIG. 1 ($A>-0.1B+2$), although the image density is high, premature printing and formation of brush marks are caused and the quality of the formed image is very poor. Especially in Comparative Examples 4 and 5, scattering of the toner is caused.

We claim:

1. A two-component developer comprising a magnetic carrier having a carbon black-containing resin coating layer and a toner composed of a carbon black-containing resin composition, wherein each of the carrier-coating resin and the toner-forming resin is a resin selected from the group consisting of a stryrene resin, an acrylic resin and a styrene-acrylic copolymer resin, and the carbon black content A (% by weight) in the carrier coating layer and the carbon black content B (% by weight) in the toner, when plotted on Cartesian coordinates with A as ordinate and B as abscissa, must satisfy the requirements represented by the following formulae:

$$A<-0.1B+2 \quad (1),$$

$$A>-0.1B+1 \quad (2),$$

$$5<B<15 \quad (3), \text{ and}$$

$$A>0 \quad (4).$$

2. A developer as set forth in claim 1, wherein the carbon black in the toner has a dibutyl phthalate (DBP) adsorption of 90 to 130 ml/100 g.

3. A developer as set forth in claim 1, wherein the carrier-coating resin is a copolymer resin comprising 10 to 30% by weight of styrene, 70 to 80% by weight of a lower alkyl (having up to 3 carbon atoms) (meth)acrylate, 0.1 to 2% by weight of a higher alkyl (having at least 4 carbon atoms) (meth)acrylate and 0.1 to 2% by weight of a hydroxyalkyl (meth)acrylate.

4. A developer as set forth in claim 1, wherein the carrier-coating resin is present in an amount of 0.01 to 5% by weight based on the magnetic carrier.

5. A developer as set forth in claim 1, wherein the toner-forming resin is a copolymer resin comprising 75 to 95% by weight of styrene and 0.5 to 5% by weight of a lower alkyl (having up to 3 carbon atoms) (meth)acrylate.

* * * * *